United States Patent [19]

Vadas et al.

[11] 4,300,292

[45] Nov. 17, 1981

[54] HEATED MILL DRIVE SYSTEM

[75] Inventors: Robert M. Vadas, Dorval; Marvin B. Shaver, Beaconsfield, both of Canada

[73] Assignee: Dominion Engineering Works Limited, Lachine, Canada

[21] Appl. No.: 119,361

[22] Filed: Feb. 7, 1980

[30] Foreign Application Priority Data

Feb. 16, 1979 [CA] Canada ..... 321825

[51] Int. Cl.[3] ..... F26B 11/04

[52] U.S. Cl. ..... 34/108; 74/606 R; 366/24; 366/144; 432/103

[58] Field of Search ..... 34/108; 432/103, 104, 432/116; 366/22, 23, 24, 25, 144, 145, 147, 148, 149; 74/606 A, 606 R

[56] References Cited

U.S. PATENT DOCUMENTS

| | | | |
|---|---|---|---|
| 1,952,464 | 3/1934 | Rybeck | 366/24 |
| 3,186,255 | 6/1965 | Schmitter et al. | 74/606 |
| 3,197,187 | 7/1965 | Lakin et al. | 74/606 |
| 3,822,651 | 7/1974 | Harris et al. | 432/116 |

FOREIGN PATENT DOCUMENTS

| | | |
|---|---|---|
| 462132 | 12/1949 | Canada . |
| 922521 | 3/1973 | Canada . |

*Primary Examiner*—Larry I. Schwartz
*Attorney, Agent, or Firm*—Raymond A. Eckersley

[57] ABSTRACT

A rotatable drum apparatus for use with a drying kiln or a dry grinding mill has a large gear wheel secured to the periphery of the drum, the drum being heated. In order to minimize the generation of undue stresses between gear wheel and drum due to thermal gradients, the apparatus includes a stationary heat shield extending about the gear in thermal stabilizing relation therewith. The arrangement includes air pressurization within the shield and seal means between stationary and rotary components, to limit the loss of heated air from the enclosure, and to preclude the ingress of air and foreign particles into the enclosure.

6 Claims, 4 Drawing Figures

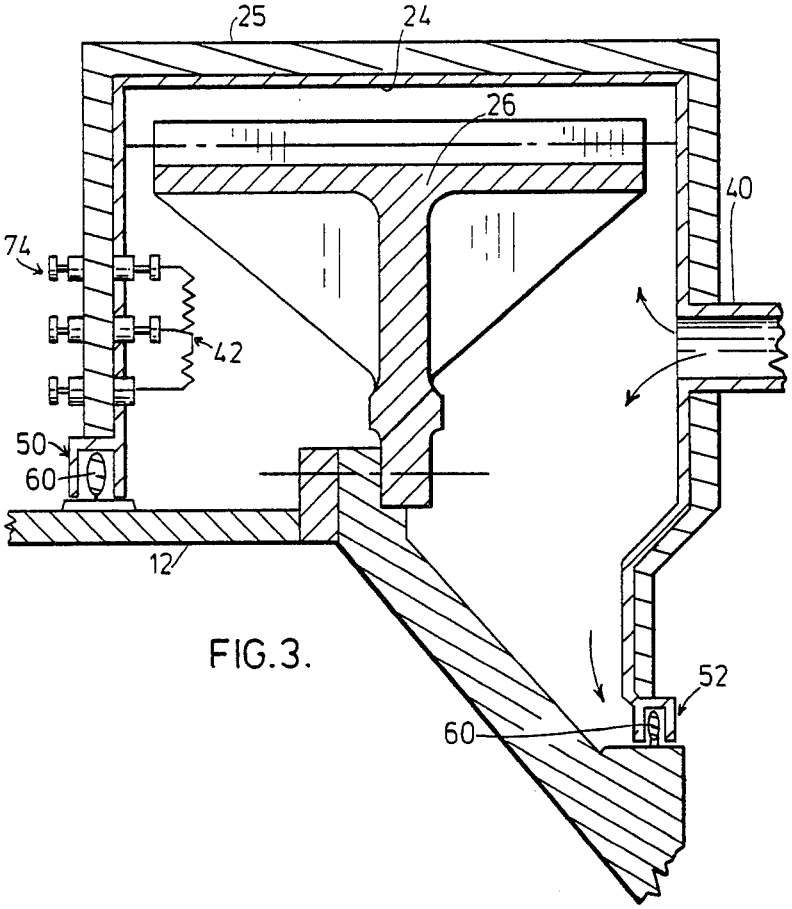
FIG.3.
FIG.4.
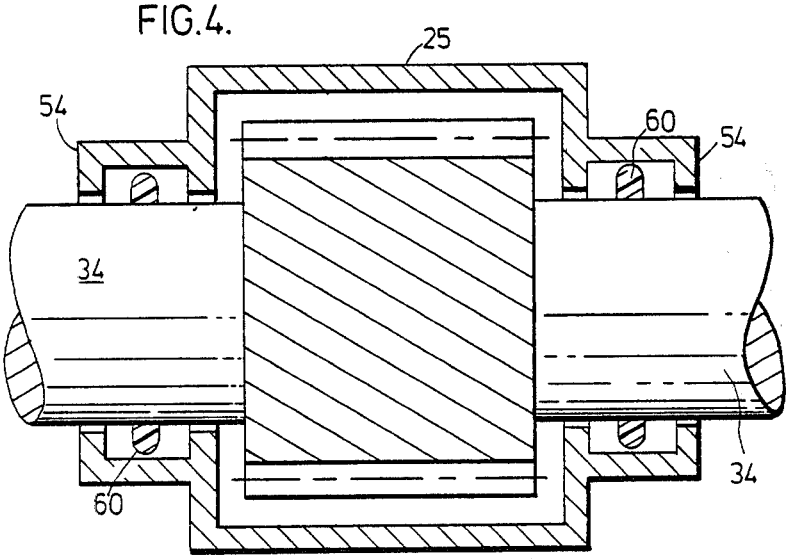

HEATED MILL DRIVE SYSTEM

This invention is directed to a heated rotary structure such as a kiln or dry grinding mill, and in particular to the driving gear used to drive the mill.

In the construction and operation of heated drying kilns and dry grinding mills significant problems arise in the attachment of the bull gear wheel to the body of the kiln or mill, due to differential thermal gradients and the uncontrolled differential expansion that takes place between the heated drum and the gear wheel, which is cooled naturally by rotation in ambient air.

The effect of such uncontrolled differential expansion has been to destabilize the tooth contact relationships between the bull gear, attached to the drum in driving relation thereto, and the driving pinion or pinions that power the mill. Also, gross loads may be generated between components of the system, due to uncontrolled thermal conditions.

In accordance with the presently disclosed arrangement there is provided a thermally protective environment, whereby the thermal condition of the gears is controlled.

Additionally, by providing a fitted cover having a gland arrangement so as to minimize air leakage between stationary and rotatable parts, and applying internal pressurization within the cover to produce an outflow of air therefrom, the ingress of cold air and of air-born contaminants may be substantially avoided.

The heating of the interior of the cover can utilize hot air to replenish leakage and thermal losses.

Alternatively or additionally, direct heating such as electrical resistance heating may be used.

The general desired condition is to achieve a predetermined temperature differential between the internal temperature of the kiln or mill, and the temperature of the gear. Appropriate temperature sensors reading the interior and/or the exterior temperature of the drum and connected in controlling relation with the gear heating device permit the establishment of predetermined temperature differentials between the drum and the gear.

Certain embodiments are described in the accompanying drawings, wherein;

FIG. 3 is a view at 3—3 of FIG. 2, and

FIG. 4 is a view at 4—4 of FIG. 2.

Figure 1:
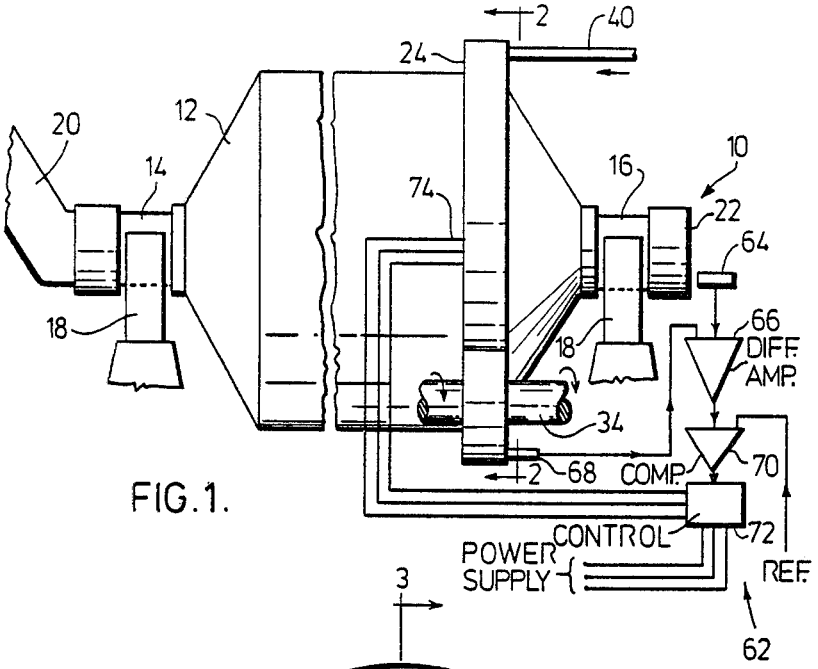
FIG. 1 is a side elevational view of an installation incorporating an embodiment of the subject gear heating system.

Referring to the drawings, in FIG. 1 the grinding mill installation 10 has a drum 12 rotatably mounted on hollow trunnions 14, 16 supported in bearings 18, having an inlet chute 20 and an outlet trommel 22.

Figure 2:
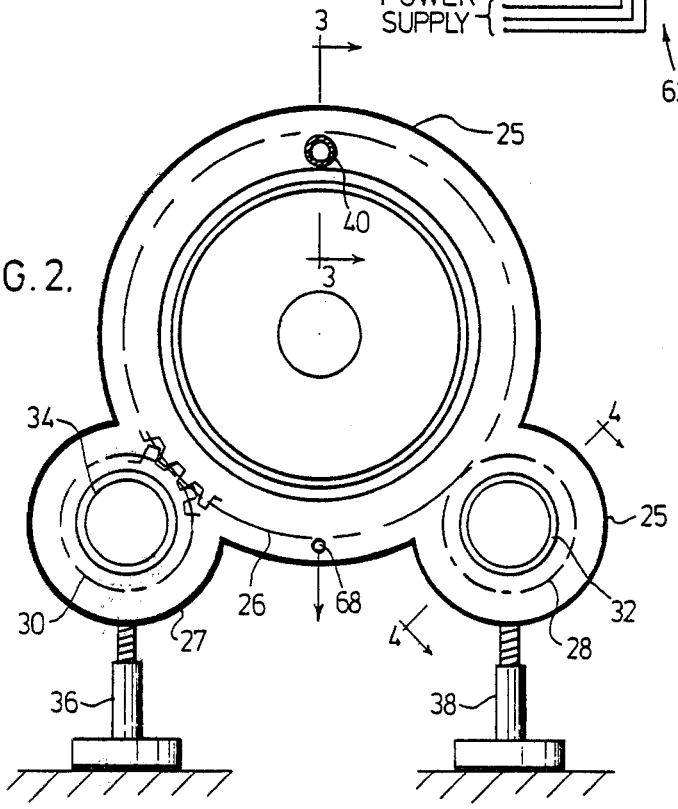
FIG. 2 is a view at 2—2 of FIG. 1.

A gear cover 24 overlies a bull gear 26 attached to the drum 12, the cover 24 including side extensions 25, 27 which contain pinions 28, 30 illustratively shown by their respective pitch circles in FIG. 2, as is also the bull gear 26. The cover 24 is provided with a suitable thermal insulating layer 25'. The pinions 28, 30 are driven by shafts 32, 34 to which the pinions are attached in known fashion.

It will be understood that a single pinion drive may be employed. The cover 24 is carried on adjustable mounts 36, 38, illustrated schematically.

An air inlet conduit 40 provides a pressurized air supply to the interior of cover 24, which air supply may be heated to any desired extent. In addition, or as an alternative, electrical heating means 42 are located within the cover 24.

Annular seals 50, 52 seal the cover 24 with the relatively rotatable drum 12, and a pair of like seals 54 seal the cover extensions 25, 27 with the pinion shafts 32, 34 respectively. Each seal 50, 52, 54 is illustrated as a labyrinth type seal having an annular ring 60 extending radially from the respectively rotary member into an annular enclosure forming a part of the respective cover portion 24, 25 and 27.

A heating control circuit 62 is illustrated in relation to the electrical heating means 42. A temperature sensor 64 "views" the interior of the drum 12, to provide an output signal proportional to drum temperature to a differential amplifier 66. A temperature sensor 68 sensing temperature within the cover 24 provides an output signal to the differential amplifier 66. A signal representative of the difference in temperature between drum 12 and cover 24 passes to a comparator 70 to which a reference signal input also is provided. The output from comparator 70 is connected to the controller 27, which regulates the power supply to the heater 42 by way of connector 74.

In operation, a reference signal input provided to comparator 70 predetermines the temperature difference required between the value of temperature in the drum interior and the air temperature within the cover 24. Accordingly, the controller 72 is regulated by the differential amplifier 66 to increase the temperature inside cover 24 to the point where the desired temperature differential is achieved. It will be understood that the same principles pertain where the temperature of cover 24 is regulated by controlling the ingress of hot air within the supply conduit 40.

Suitable combinations of control may be effected, including regulating the air inlet supply by admitting cold air, if desired, to reduce the temperature within cover 24. It will be understood that air leakage outwardly past the seals 50, 52, 54 can effectively preclude the ingress of air and/or air borne contamination, such that life and operation of the gears is promoted.

What I claim as new and desire to secure by Letters Patent of the United States is:

1. In a rotatable mill apparatus having a heated drum rotatably mounted for rotation about the polar axis of the drum, including a large gear wheel for driving the drum and physically attached to the outer circumference of the drum in torque transmitting relation therewith, the improvement comprising gear guard means including heat insulation means extending about the gear in substantially shrouding relation therewith having seal means to limit air transfer therepast and heating means for heating the gear wheel and the interior of the gear guard.

2. The mill apparatus as claimed in claim 1 wherein said heating means includes hot air supply means connected to said gear guard in internal pressurizing relation therewith, to substantially preclude the ingress of contaminating air-born particles into said gear guard.

3. The mill apparatus as claimed in claim 1, said seal means comprising annular seal rings extending within labyrinth walls, each said seal ring being rotatable relative to said walls, about said ring polar axis.

4. The mill apparatus as claimed in claim 3, said labyrinth walls extending radially relative to the periphery of said drum.

5. The mill apparatus as claimed in claim 1, said gear guard extending in substantial sealing relation about a pinion gear mounted in operative meshing relation with said gear wheel.

6. In a rotatable mill apparatus having a heated drum rotatably mounted for rotation about the polar axis of the drum, including a large gear wheel for driving the drum and physically attached to the outer circumference of the drum in torque transmitting relation therewith, the improvement comprising gear guard means extending about the gear in substantially shrouding relation therewith having seal means to limit air transfer therepast, heating means for heating the gear wheel and the interior of the gear guard, and pressurized air supply means to provide air leakage outwardly past said seal means.

* * * * *